US009370686B2

(12) United States Patent
Lee

(10) Patent No.: US 9,370,686 B2
(45) Date of Patent: Jun. 21, 2016

(54) TREADMILL

(71) Applicant: Byung Don Lee, Seoul (KR)

(72) Inventor: Byung Don Lee, Seoul (KR)

( * ) Notice: Subject to any disclaimer, the term of this patent is extended or adjusted under 35 U.S.C. 154(b) by 215 days.

(21) Appl. No.: 14/348,039

(22) PCT Filed: Sep. 27, 2012

(86) PCT No.: PCT/KR2012/007791
§ 371 (c)(1),
(2) Date: Mar. 27, 2014

(87) PCT Pub. No.: WO2013/048129
PCT Pub. Date: Apr. 4, 2013

(65) Prior Publication Data

US 2014/0235410 A1 Aug. 21, 2014

(30) Foreign Application Priority Data

Sep. 28, 2011 (KR) ..... 10-2011-0098519

(51) Int. Cl.
*A63B 22/02* (2006.01)
*A63B 23/04* (2006.01)
*A63B 71/06* (2006.01)

(52) U.S. Cl.
CPC ..... *A63B 22/02* (2013.01); *A63B 22/0242* (2013.01); *A63B 22/0285* (2013.01); *A63B 23/04* (2013.01); *A63B 2071/065* (2013.01)

(58) Field of Classification Search
CPC ..... A63B 22/02; A63B 22/0207; A63B 22/0235; A63B 22/0271; A63B 22/0278; A63B 22/0285; A63B 22/0292; A63B 2202/0278
See application file for complete search history.

(56) References Cited

U.S. PATENT DOCUMENTS 5,827,155 A 10/1998 Jensen et al.
5,976,061 A 11/1999 Moon et al.
7,628,733 B2 * 12/2009 Donner ..... A63B 22/0228 482/54

FOREIGN PATENT DOCUMENTS

JP 11-319144 A 11/1999
KR 20-0261701 Y1 1/2002
KR 10-0829774 B1 5/2008
WO 2009/014330 A1 1/2009

* cited by examiner

*Primary Examiner* — Loan H Thanh
*Assistant Examiner* — Rae Fischer
(74) *Attorney, Agent, or Firm* — Revolution IP, PLLC

(57) ABSTRACT

Disclosed is a treadmill which comprises: a main frame; a treadmill belt which is installed inside said main frame, and rotates in connection with the rotation of a support roller through an operation of a driving unit; and a pair of left and right support decks which are placed in an inner space of said treadmill belt, and support said treadmill belt when pressure is applied to an upper surface of said treadmill belt from an upper side, wherein said support decks are installed to move along a guide rail installed in said main frame in connection with the rotation of said treadmill belt and running of a user.

5 Claims, 10 Drawing Sheets

TREADMILL

CROSS REFERENCE TO PRIOR APPLICATIONS

This application is a National Stage Application of PCT International Patent Application No. PCT/KR2012/007791 filed on Sep. 27, 2012, under 35 U.S.C. §371, which claims priourity to Korean Patent Application No.10-2011-0098519 filed on Sep. 28, 2011, which are all hereby incorporated by reference in their entirety.

TECHNICAL FIELD

The present invention relates to a treadmill, and more particularly, to a treadmill capable of minimizing frictional resistance between a running belt and a support deck during a walking or running operation to save driving energy for rotation of the running belt, and minimizing application of an excessive load to parts related to the rotation of the running belt to increase durability.

BACKGROUND ART

In general, treadmills in which a running belt is rotated by a power source, an exerciser runs or walks on the rotating running belt, and thus the exerciser can perform exercise are being developed in various types.

An example of such a treadmill is disclosed in Korean Utility Model Registration No. 20-0261701 described below that is a patent document.

A treadmill 1 of the related art s constituted by a driving roller 7 and a driven roller 9, each having both ends supported by a frame 10, disposed in parallel a constant distance from each other, and an endless running belt 8 wound on the rollers 7 and 9, so that the running belt 8 is circulated when power generated from a driving motor 5 is transmitted to the driving roller 7 via a power transmission means such as a chain 6 or a belt.

In addition, belt support plate 10*a* is installed under a relaxation side of the running belt 8 to prevent the running belt 8 from hanging downward by the weight of an exerciser on the running belt 8.

However, in the treadmill of the related art, since the support deck 10*a* configured to support the running belt 8 is fixedly installed at the frame 10, a frictional force is always mutually generated between the running belt 8 and the belt support plate 10*a* while the running belt 8 rotates.

That is, in the treadmill of the related art, the running belt rotating while the exerciser walks or runs comes in contact with the fixed support deck 10*a*, a frictional load occurs whenever such contacts occur, and thus, consumption of electrical energy of the driving motor 5 due to an increase in frictional load is increased to cause waste of energy.

In addition, an excessive load is applied to a bearing configured to support a rotary shaft of the driving motor 5 and the running belt 8 to reduce the lifespan thereof.

CITATION LIST

Patent Literature

[Patent Literature 1]

Korean Utility Model Registration No. 20-026701 (registered on Jan. 11, 2002)

SUMMARY OF INVENTION

Technical Problem

An object of the present invention is to provide a treadmill capable of minimizing frictional resistance between a running belt and a support deck and saving driving energy for rotation of the running belt by making it to be movable by interlocking with movement of the support deck configured to prevent the running belt from hanging with rotation of the running belt and running of an exerciser.

In addition, another object of the present invention is to provide a treadmill capable of converting kinetic energy generating during exercise into electrical energy to enable reuse thereof.

Tasks of the present invention are not limited to the above-mentioned matters, and the other tasks will be clearly understood by those skilled in the art from the following description.

Solution to Problem

In order to achieve the aforementioned objects, there is provided a treadmill including: a main frame; a running belt installed in the main frame and rotated by interlocking with rotation of a support roller through an operation of a driving unit; and a pair of left and right support decks provided in an air inner space of the running belt and configured to support the running belt when a pressure is applied to an upper surface of the running belt from above, wherein the support decks are movably installed along guide rails installed at the main frame by interlocking with rotation of the running belt and running of a user.

Here, the treadmill may further include a position recovering means configured to recover the support deck to a front position after rearward movement along the guide rail, wherein the position recovering means includes a fixed piece installed at the main frame and provided with a bearing; a stopper spaced rearward apart from the fixed piece and installed at a bottom surface of the support deck; a screw shaft having one end connected to the fixed piece; a mover threadedly engaged with a screw portion of the screw shaft; a shock absorbing spring supported by an outer circumferential portion of the screw shaft and installed between the fixed piece and the stopper; a return spring installed between the stopper and the mover; and a motor connected to the other end of the screw shaft to rotate the screw shaft.

The treadmill may further include a generating motor installed at the main frame and at which a chain gear is installed; and a chain having one end connected to the support deck and installed to be meshed with the chain gear, wherein a one-way bearing is installed between a rotary shaft of the generating motor and the chain gear, the generating motor generates electrical energy when the support deck is moved rearward, and a return spring is installed between the other end of the chain and a support piece of the main frame to be resiliently moved forward again when the support deck is moved rearward to a certain extent or more.

The treadmill may further include a coil portion installed at the main frame in a longitudinal direction of the guide rail; and a magnet installed at a lower portion of the support deck at a position corresponding to the coil portion.

The treadmill may further include an auxiliary support frame installed in an inner space of the running belt at a rear side of the support deck and configured to prevent the running belt from hanging downward when a load is applied from above in an operation stoppage state of the driving unit, wherein the auxiliary support frame includes: a motor installed at the main frame; a ball screw connected to the rotary shaft of the motor; a movable bracket moved in a longitudinal direction of the ball screw according to a motion of the ball screw; a plurality of rotational links installed to be rotatably hinged by interlocking with movement of the movable bracket; and a support plate installed at an upper portion of the rotational link and configured to elevate by rotation of the rotational link, wherein an upper surface of the support plate is flush with an upper surface of the support deck when the support plate is raised to be disposed at a peak.

Advantageous Effects of Invention

The treadmill according to the embodiment of the present invention has the following effects.

First, as the support deck is configured to be movable forward and rearward by interlocking with rotation of the running belt and running motion of an exerciser, frictional resistance between the running belt and the support deck can be minimized to save driving energy for rotation of the running belt.

Second, power can be generated using a propulsive force generated when an exerciser pushes the running belt rearward with his/her feet upon running of the exerciser.

Third, as an auxiliary support unit is installed inside the running belt, when an exerciser steps up on an upper rear portion of the running belt to perform exercise, damage to the running belt due to depression downward caused by the weight of the exerciser and a safety accident of the exerciser can be prevented.

Effects of the present invention are not limited to the above-mentioned matters, and the other effects will be clearly understood by those skilled in the art from the following description.

DESCRIPTION OF EMBODIMENTS

Figure 1:
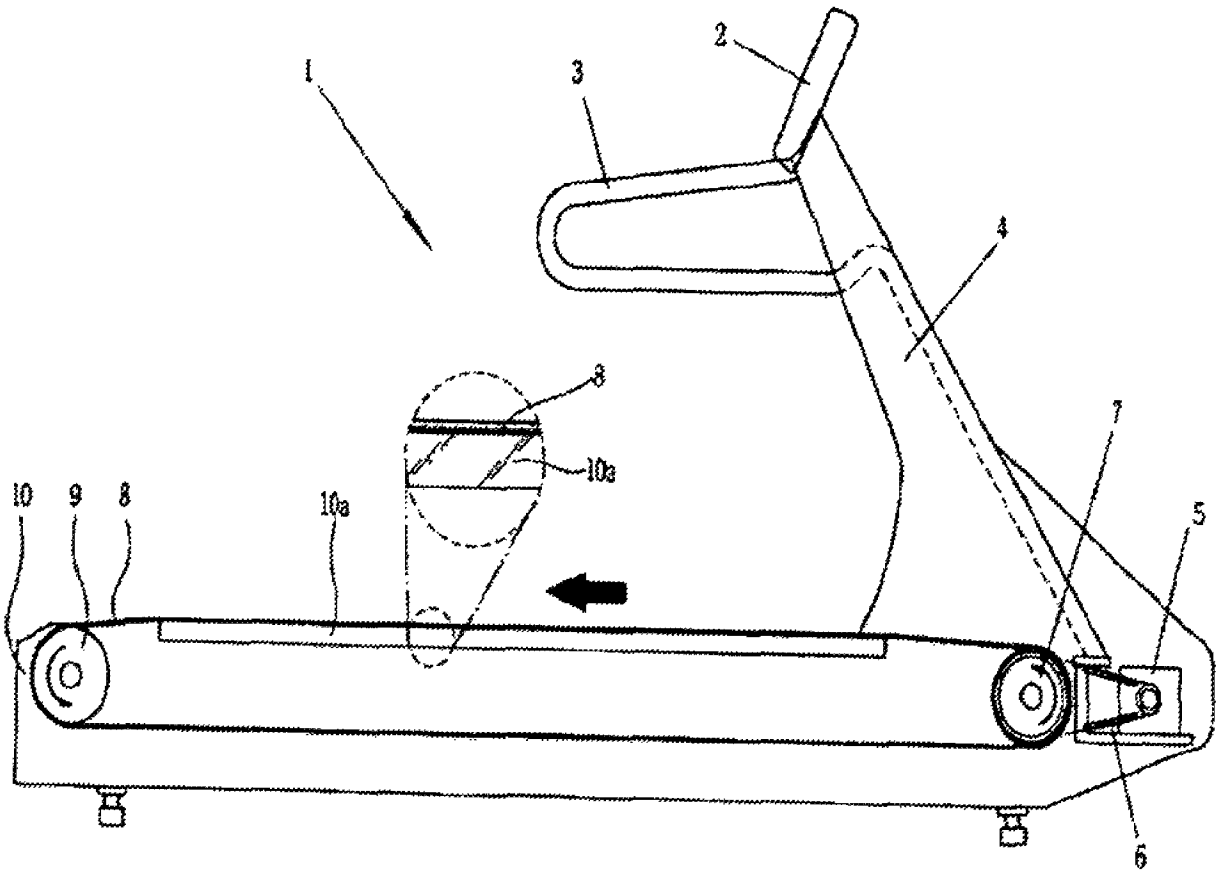
FIG. 1 is a cross-sectional view showing a treadmill of the related art.

Hereinafter, an embodiment of the present invention will be described in detail with reference to the accompanying drawings. However, the present invention is not limited to the embodiment to be described below but may be implemented in various different types. The embodiment is merely provided to completely disclose the present invention and completely inform those skilled in the art of the spirit of the present invention. Like reference numerals in the drawings designate like element.

Figure 2:
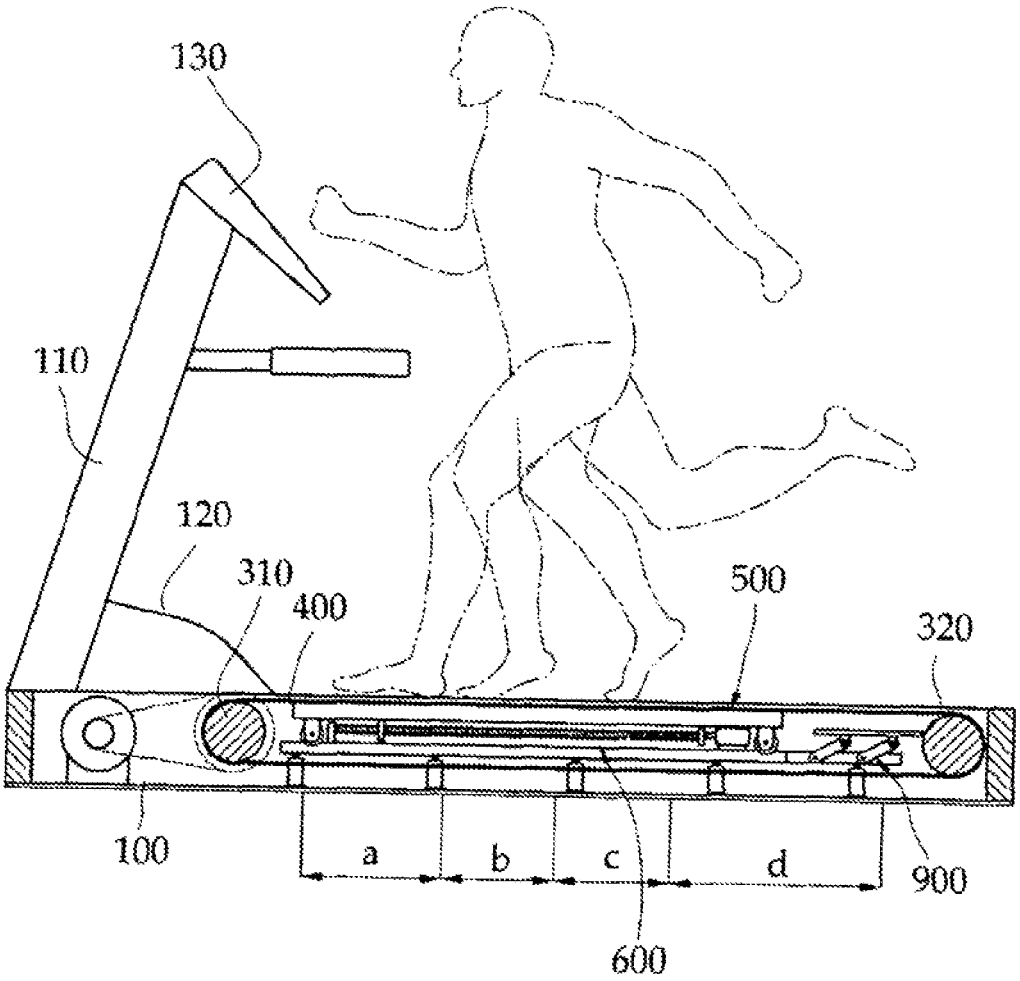
FIG. 2 is a view showing a treadmill according to an embodiment of the present invention.
Figure 3:
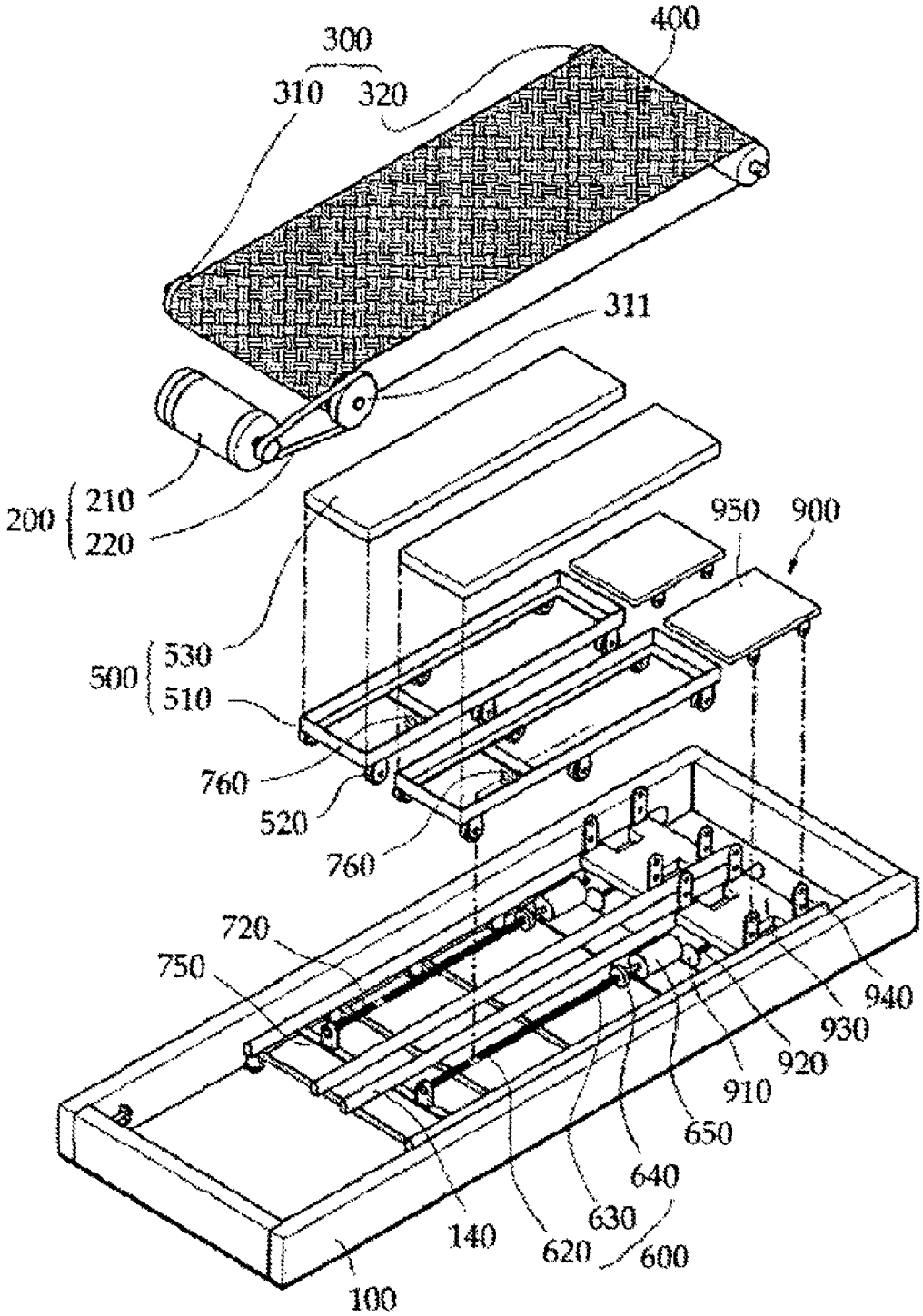
FIG. 3 is an exploded perspective view showing the treadmill according to the embodiment of the present invention.
Figure 4:
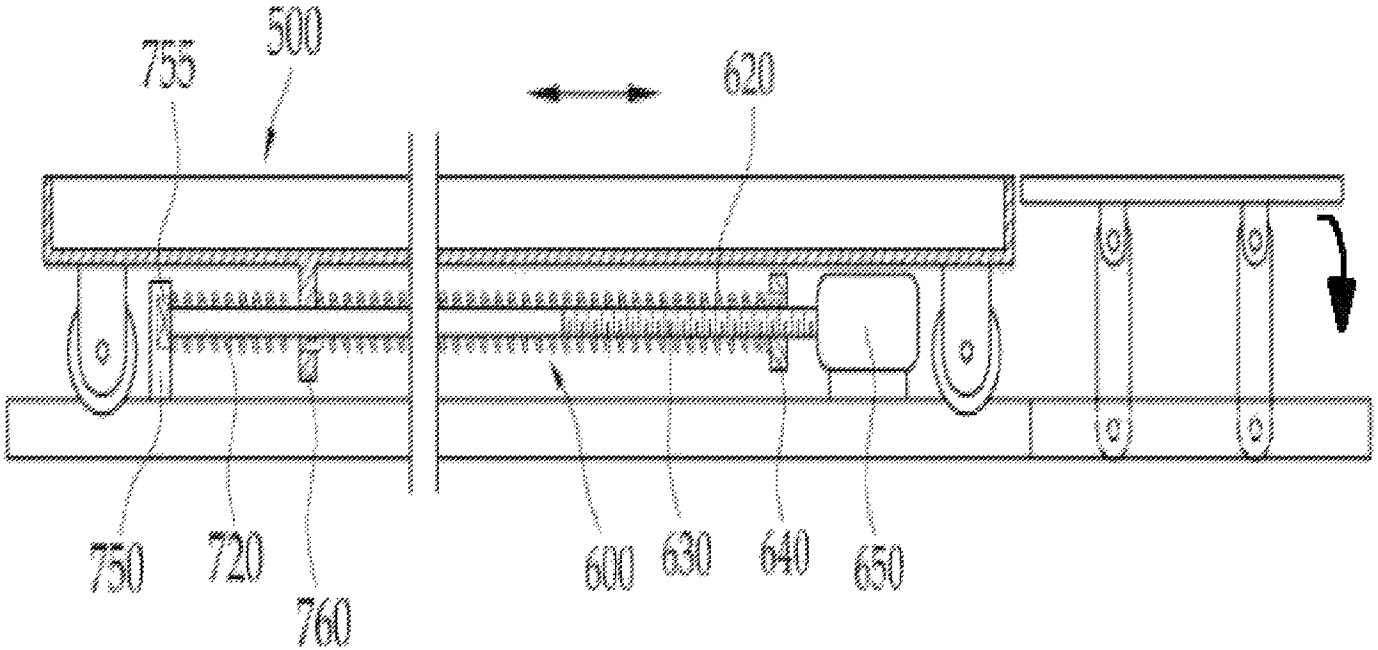
FIG. 4 is a side cross-sectional view showing a main frame and an auxiliary support frame according to the embodiment of the present invention.
Figure 5:
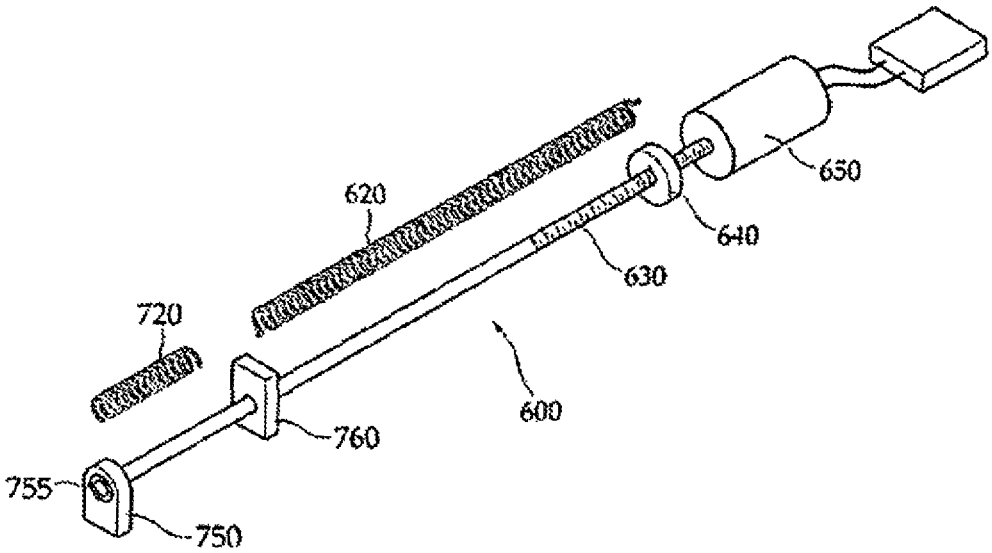
FIG. 5 is a perspective view showing a position recovering means according to the embodiment of the present invention.
Figure 6:
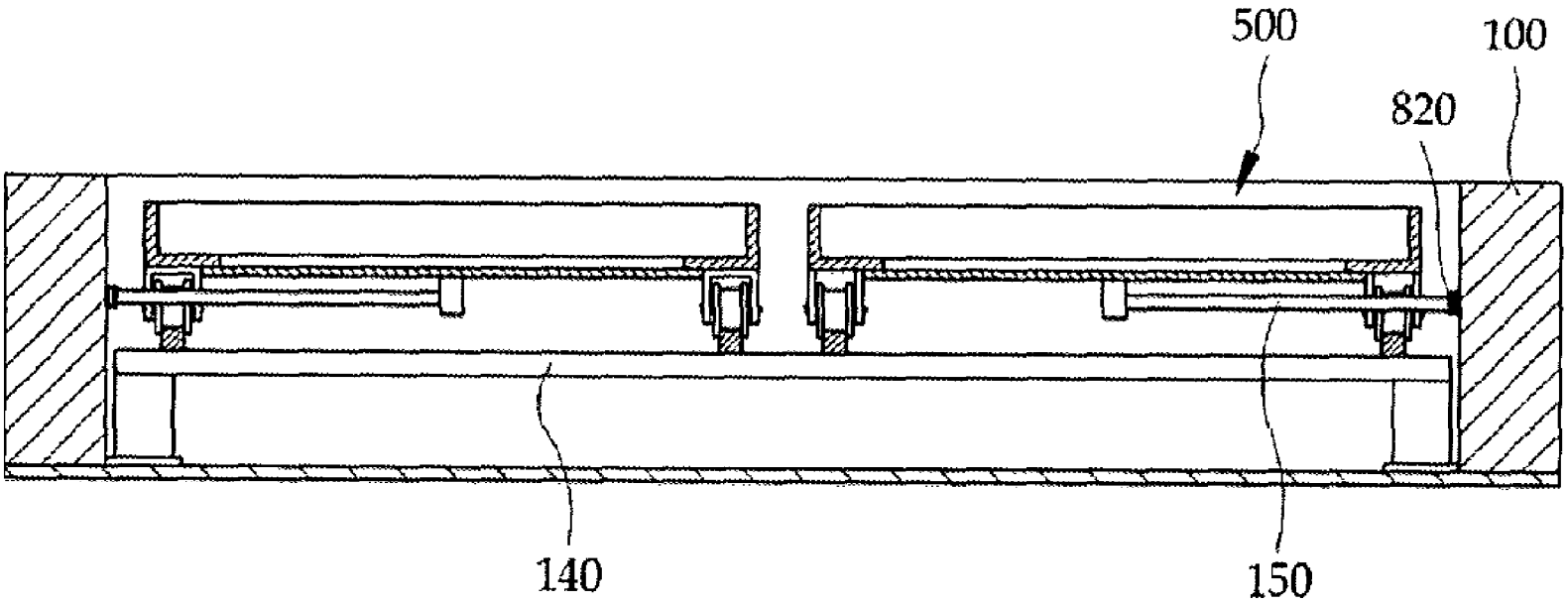
FIG. 6 is a front cross-sectional view showing the main frame and the auxiliary support frame according to the embodiment of the present invention.

FIG. 2 is a view showing a treadmill according to an embodiment of the present invention, FIG. 3 is an exploded perspective view showing the treadmill according to the embodiment of the present invention, FIG. 4 is a side cross-sectional view showing a main frame d an auxiliary support frame according to the embodiment of the present invention, FIG. 5 is a perspective view showing a position recovering means according to the embodiment of the present invention, and FIG. 6 is a front cross-sectional view showing the main frame and the auxiliary support frame according to the embodiment of the present invention.

Figure 7:
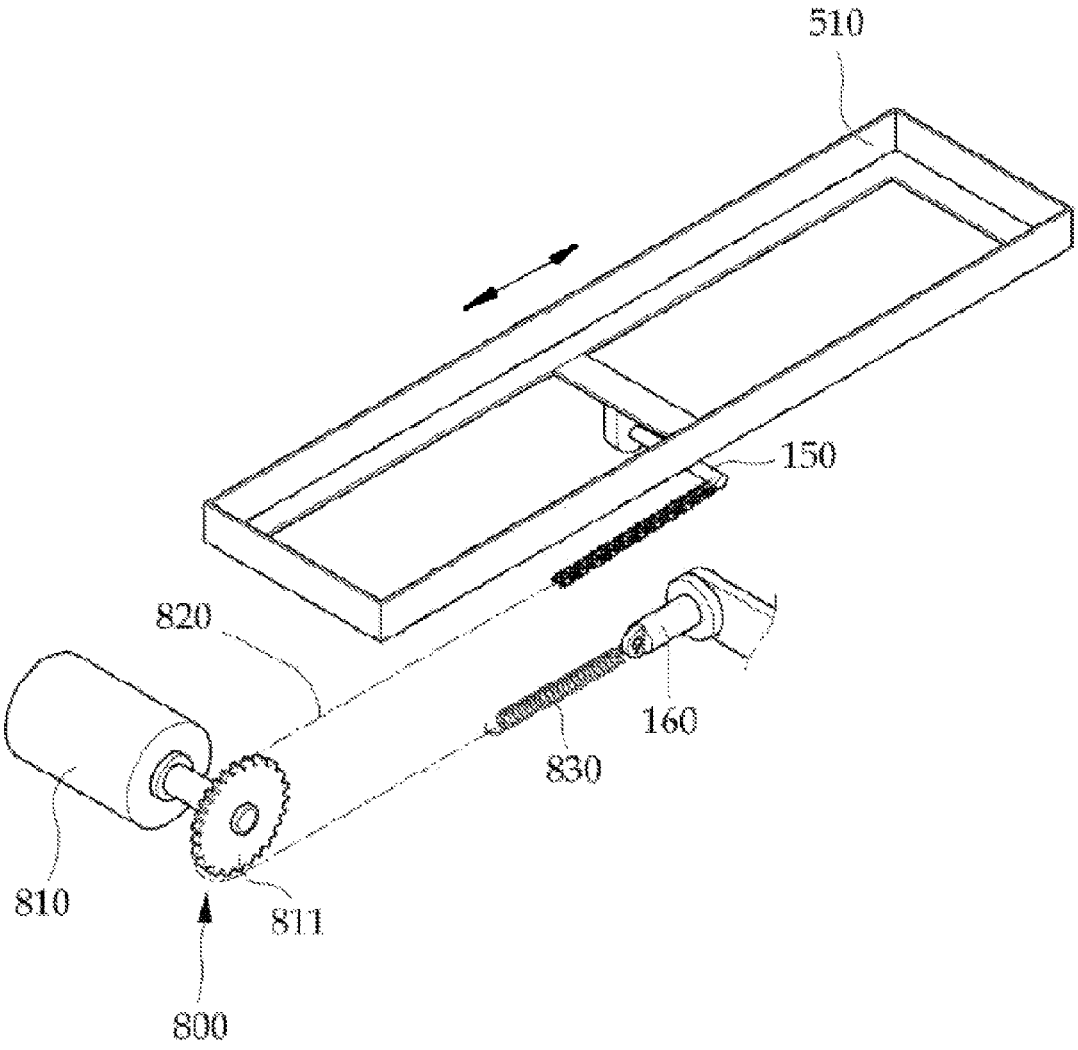
FIG. 7 is a perspective view showing an example of a power generating means of the treadmill according to the embodiment of the present invention.
Figure 8:
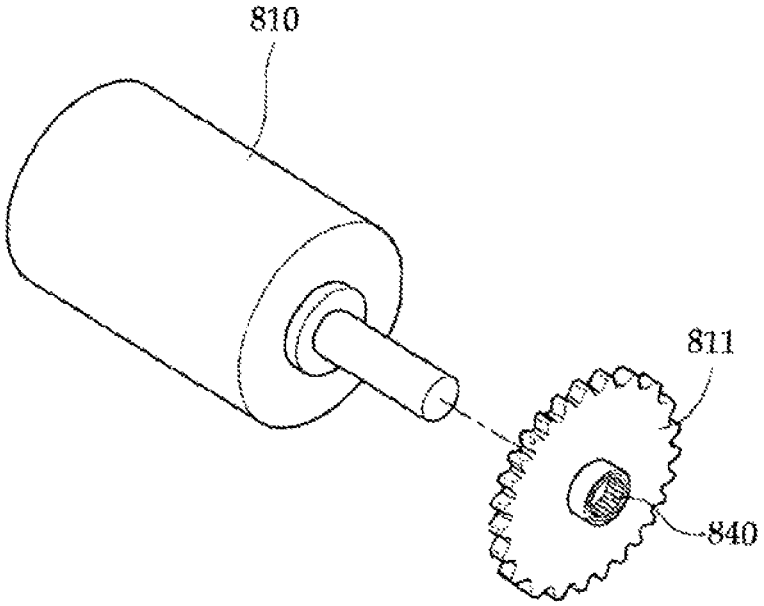
FIG. 8 is a perspective view showing a state in which a one-way bearing installed in the power generating means of the treadmill according to the embodiment of the present invention.
Figure 9:
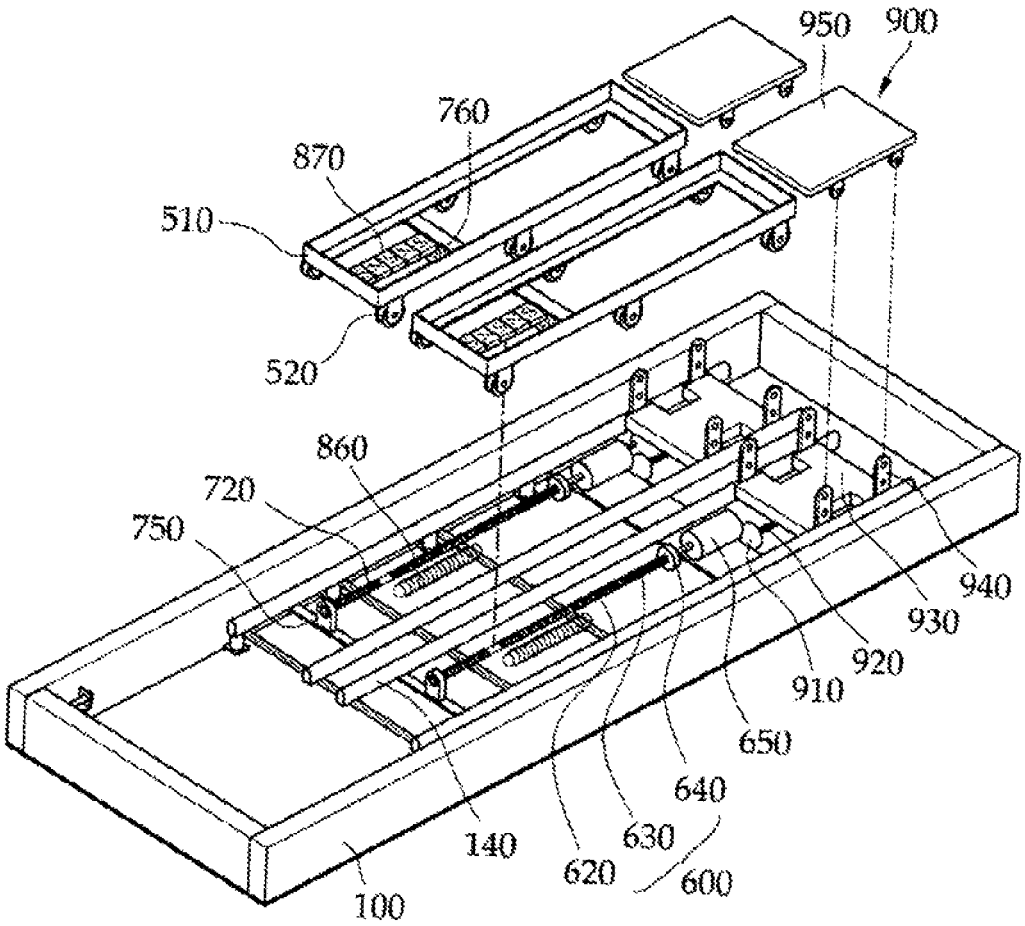
FIG. 9 is a perspective view showing another example of the power generating means of the treadmill according to the embodiment of the present invention.

FIG. 7 is a perspective view showing an example of a power generating means of the treadmill according to the embodiment of the present invention, FIG. 8 is a perspective view showing a state in which a one-way bearing installed in the power generating means of the treadmill according to the embodiment of the present invention, FIG. 9 is a perspective view showing another example of the power generating means of the treadmill according to the embodiment of the present invention, and FIGS. 10A and 10B are views showing an operation relation of the auxiliary support frame according to the embodiment of the present invention.

As shown in the drawings, the treadmill according to the exemplary embodiment of the present invention is configured to reduce frictional resistance between components in contact with each other during exercise of a user and convert a propulsive three generated during the exercise into electrical energy, and includes a main frame 100, a running belt 400 installed in the main frame 100 and rotated by interlocking with rotation of a support roller 520 through an operation of a driving unit 200, and a support deck 500 provided in an inner space of the running belt 400 and configured to support the running belt 400 when a pressure is applied to an upper surface of the running belt 400 from above.

The pair of left and right support decks may be installed at left and right sides on which left and right feet of a user are disposed. This is because the support decks are installed at the left and right sides such that the support decks can in independently operated while running of a user. Hereinafter, only one of the pair of support decks will be described for the convenience of description.

In addition, the treadmill further includes a position recovering means 600 configured to recover the support deck 500 to an initial position by performing rearward movement again after rearward movement of the support deck 500 by interlocking with rotation of the running belt 400 and running of the user.

First, the main flame 100 forms an appearance of a lower portion of the treadmill and has a substantially rectangular shape to provide an internal accommodating space. A vertical frame 110 is formed at one side of the main frame 100 to extend upward, and has one end assembled to the main frame 100 and the other end having a handrail 120 assembled to the vertical frame 110.

Here, a control panel 130 is installed at an upper portion of the vertical frame 110 to check an exercise state, control a quantity of motion, and control an electrical action of the treadmill according to the embodiment.

Specifically, the control panel 130 includes a display panel configured to display a rotational speed of the running belt 400, an exercise distance of the exerciser, a consumed calorie, an exercise course, and so on, and various buttons for ON/OFF of an operation of the running belt 400, adjustment of a rotational speed, a general stop and an emergency stop.

In the embodiment, as shown in FIGS. 2 and 3, a pair of support rollers 310 and 320 are rotatably supported at front and rear regions in the main frame 100 through bearings. For the convenience of description, a support roller disposed at a front side of the main frame 100 is referred to as a front support roller 310, and a support roller disposed at a rear side is referred to as a rear support roller 320. The running belt 400 is installed to surround the front and rear support rollers 310 and 320. Here, the driving unit 200 configured to rotate the running belt 400 is installed at an inner space of one side of the main frame 100.

Specifically, a driving motor 210 configured to generate rotational power through electric power applied from the outside is installed at the inner space of one side of the main frame 100, and a motor pulley is mounted on a motor shaft of the driving motor 210. Here, a pulley 311 is mounted on one side of the front support roller 310 such that the front support roller 310 is rotated by the power of the driving motor 210.

That is, a driving belt 220 is wound on the pulley 311 of the front support roller 310 and the motor pulleys of the driving motor 210 such that the front support roller 310 is rotated by the power of the driving motor 210. However, the present invention is not limited thereto but the pulley 311 and the driving belt 220 may be replaced with a chain, a sprocket wheel, a gear module, and so on.

Reviewing a specific operating relation, the front support roller 310 is rotated driving the driving motor 210 and thus, the running belt 400 in surface contact with the front support roller 310 is rotated while surrounding the front and rear support rollers 310 and 320.

In the embodiment, as shown in FIGS. 2 to 5, the support deck 500 is further installed to further reduce mutual frictional force with the running bell 400 when the exerciser runs on the running belt 400.

The support deck 500 is partly disposed in an inner space of the running belt 400 to support running belt 400 when a pressure is applied to an upper surface of the running belt 400 from above due to the weight of the exerciser or the like, and is movably installed in a longitudinal direction of the main frame 100.

Specifically, as shown in FIG. 3, four rows of guide rails 140 are installed inside the main frame 100, and support decks 500 are installed at left and right sides in the main frame 100 to move along the guide rails 140. Here, the support decks 500 are installed at positions corresponding to both feet of the exerciser, and include a container 510 having rollers 520 installed at a lower surface thereof and configured to come in contact with the guide rails 140, and a support plate 530 placed on the container 510. The support decks 500 move along the guide rails 140 by interlocking with rotation of the running belt 400 and running of the exerciser. In addition, when the soles of the exerciser come in contact with the running belt 400 to push the running belt 400 rearward, the support decks 500 move rearward along the guide rails 140.

As described above, the support deck 500 moves with the running belt 400 to a rear side of the main frame 100 when the exerciser pushes the running belt 400 rearward rather than maintaining a stopped state upon rotation of the running belt 400, and thus, a mutual frictional force generated between the support deck 500 and the running belt 400 can be reduced in comparison with a structure in which the support deck of the related art is fixedly installed. As described above, the frictional resistance between the running belt 400 and the support deck 500 while walking or running of the exerciser can be minimized to save driving energy for rotation of the running belt 400.

If the support deck 500 is not movably installed as described in the related art, a load equal to or larger than a rated capacity may be applied to the driving motor 210 due to the contact frictional force generated between the support deck 500 and the running belt 400, and in a severe case, the driving motor may be damaged. Accordingly, in the present invention, due to the above-mentioned reason, durability of the driving motor 210 and the running belt 400 can be enhanced.

Meanwhile, the embodiment may further include the position recovering means 600 configured to resiliently recover the support deck 500 moved rearward to a front initial position when the soles of the exerciser are not in contact with the running belt 400.

As shown in FIGS. 2 to 5, the position recovering means 600 includes a return spring 620 configured to recover the support deck, and a shock absorbing spring 720 configured to absorb a shock generated upon forward/rearward movement of the support deck.

The shock absorbing spring 720 is a compression spring but may be optionally replaced with a shock absorber.

The return spring 620 and the shock absorbing spring 720 are supported by an outer circumferential surface of a screw shaft 630.

More specifically, a fixed piece 750 is installed at the main frame 100 at a front side of the position recovering means 600, and a stopper 760 is spaced rearward apart from the fixed piece 750 to be integrally installed at a bottom surface of the support deck 500. Here, the shock absorbing spring 720 is installed between the fixed piece 750 and the stopper 760.

One end of the screw shaft 630 is rotatably connected to the fixed piece 750 including a bearing 755, and the other end thereof is connected to a motor 650. In addition, a mover 640 is threadedly engaged with a screw portion of the screw shaft 630 near he motor 650. A screw portion is formed inside the mover 640.

The return spring 620 configured to recover the support deck is installed between the stopper 760 and the mover 640. Here, the return spring 620 is integrally coupled to one surface of the stopper 760 by welding or a separate fixing device.

The motor 650 is installed at the main frame 100.

In this structure, when the support deck 500 moves rearward to a certain distance or more along the guide rail 140 by the running of the exerciser, the stopper 760 resiliently compresses the return spring 620 and stores energy for conveying the support deck 500 forward. That is, when the foot of the exerciser is spaced apart from the running belt 400, the support deck 500 is recovered to the front initial position by the resilient recovering force of the return spring 620. Upon the recovery, the stopper 760 comes in contact with the shock absorbing spring 720 to absorb a shock generated from the support deck.

In addition, in the present invention, a length of the compressed spring can be adjusted to adjust a compression force of the return spring 620. That is, when the user increases or decreases the speed, in order to adjust the return speed of the left and right support deck according to a variation in moving speed, the compression length of the return spring 620 is adjusted.

When the user increases the speed of the treadmill, the number of steps is accordingly proportionally increased. Here, when the return speed of the left and right support decks 500 to the original position is not matched with the stepping speed, forward and rearward strokes of the left and right support decks 500 are reduced. As a result, the moving distance of the support deck is reduced, and thus, a generation amount is largely decreased.

Accordingly, creases the speed, the motor 650 is rotated through a control unit in which a functional relation between the speed and the spring length is programmed, and when the screw shaft 630 is rotated in a normal direction, the mover 640 moves forward. Then, the compression force of the return spring 620 is increased, and thus, the recovering speed is increased.

When the user decreases the speed, an operation is performed in a reverse order of the above-mentioned operation to perform adjustment.

As shown in FIGS. 5 to 8, the embodiment further includes a power generating means 800 configured to convert a propulsive force (a force of pushing the running belt with the foot rearward) of the exerciser into electrical energy.

The power generating means 800 includes a generating motor 810 installed at the main frame 100 and having a rotary shaft at which a chain gear 811 is installed, and a chain 820 having one end connected to the support deck 500 and installed to be locked by the chain gear 811.

The generating motor 810 is installed in an appropriate space in the main frame 100, and the chain gear 811 is installed at the rotary shaft. A support rod 150 is formed at a lower portion of a center of the support deck 500 to laterally protrude, and one end of the chain 820 is fixed to the support rod 150. Here, the chain 820 may be fixed to the support rod 150 through a bolt coupling type or the like. Accordingly, when the support deck 500 is moved re by the running of the exerciser, the chain gear 811 is also rotated in the normal direction and the generating motor 810 generates electricity.

Meanwhile, as shown in FIG. 7, a return spring 830 is installed between the other end of the chain 820 and a support piece 160 of the main frame 100 such that the support deck 500 can be moved rearward to a certain extent and then resiliently moved forward by the position recovering means 600. Here, a coil spring may be used as the return spring 830, and an end of the return spring 830 may be fixed to the chain 820 through threadedly engagement or the like.

Meanwhile, when the support deck 500 is moved rearward, the chain gear 811 is rotated in the normal direction by movement of the chain 820, and similarly, when the support deck 500 is moved forward, the chain gear 811 is rotated in a reverse direction by movement of the chain 820.

In the embodiment, a one-way bearing 840 is installed between the rotary shaft of the generating motor 810 and the chain gear 811 such that the rotary shaft of the generating motor 810 is idled when the support deck 500 is moved forward. Accordingly, the electrical energy is generated by the generating motor 810 only when the support deck 500 is moved rearward.

Here, the electrical energy generated from the generating motor 810 is charged to a separate battery (not shown), and may be used as an energy source for operating a manipulation panel or the like of the treadmill.

FIG. 9 shows another example of the power generating means configured to convert a propulsive force (a force of pushing the running belt with the foot) of the exerciser into electrical energy.

As shown in FIG. 9, a coil portion 860 is installed at he main frame 100 in a longitudinal direction of the guide rail 140. In addition, when the support deck 500 is installed on the guide rail 140, magnets 870 haying N and S polarities, which are alternately disposed, are installed at a lower portion of the support deck 500 corresponding to the coil portion 860. Here, positive and negative polarity output wires of the coil portion 860 can be connected to a separate battery. Here, a spacing distance between the coil portion 860 and the magnet 870 may be formed such that a magnetic field of the coil portion 860 can be sufficiently varied upon movement of the magnet 870 as described below.

In the embodiment as described above, power can be generated by an installation structure of the coil portion 860 and the magnet 870 when the support deck 500 is reciprocated forward/rearward by running of the exerciser. Specifically, when the magnet 870 is reciprocated over the coil portion 860 according to forward/rearward movement of the support deck 500, the magnetic field generated at the coil portion 860 is varied by electromagnetic induction, and thus, are electric current is induced to the coil portion 860 by an induced electromotive force. Briefly describing, an induced current is generated from the coil portion 860 by relative movement of the magnet 870 and the coil portion 860, and the induced current can be charged to the battery.

Meanwhile, as described above, the support deck 500 is reciprocally moved to an appropriate distance along the guide rail 140 inside the running belt 400, and thus, a partial region of the running belt 400 may not be sufficiently supported by the support deck 500 upon power off of the treadmill.

In addition, when the driving of the driving motor 210 configured to rotate the front support roller 310 is stopped, the support deck 500 is recovered to an initial set position, and at his time, an empty space is formed in a rear side of the support deck 500 to a certain extent or more. Meanwhile, the exerciser first steps on an upper rear portion of the running belt 400 to run thereon. Here, as described above, when an empty space is formed at a rear side of the support deck 500 to a certain extent or more, the exerciser's foot may be fallen down. In other words, the upper rear portion of the running belt 400 cannot support the eight of the exercise and is depressed.

Figure 10:
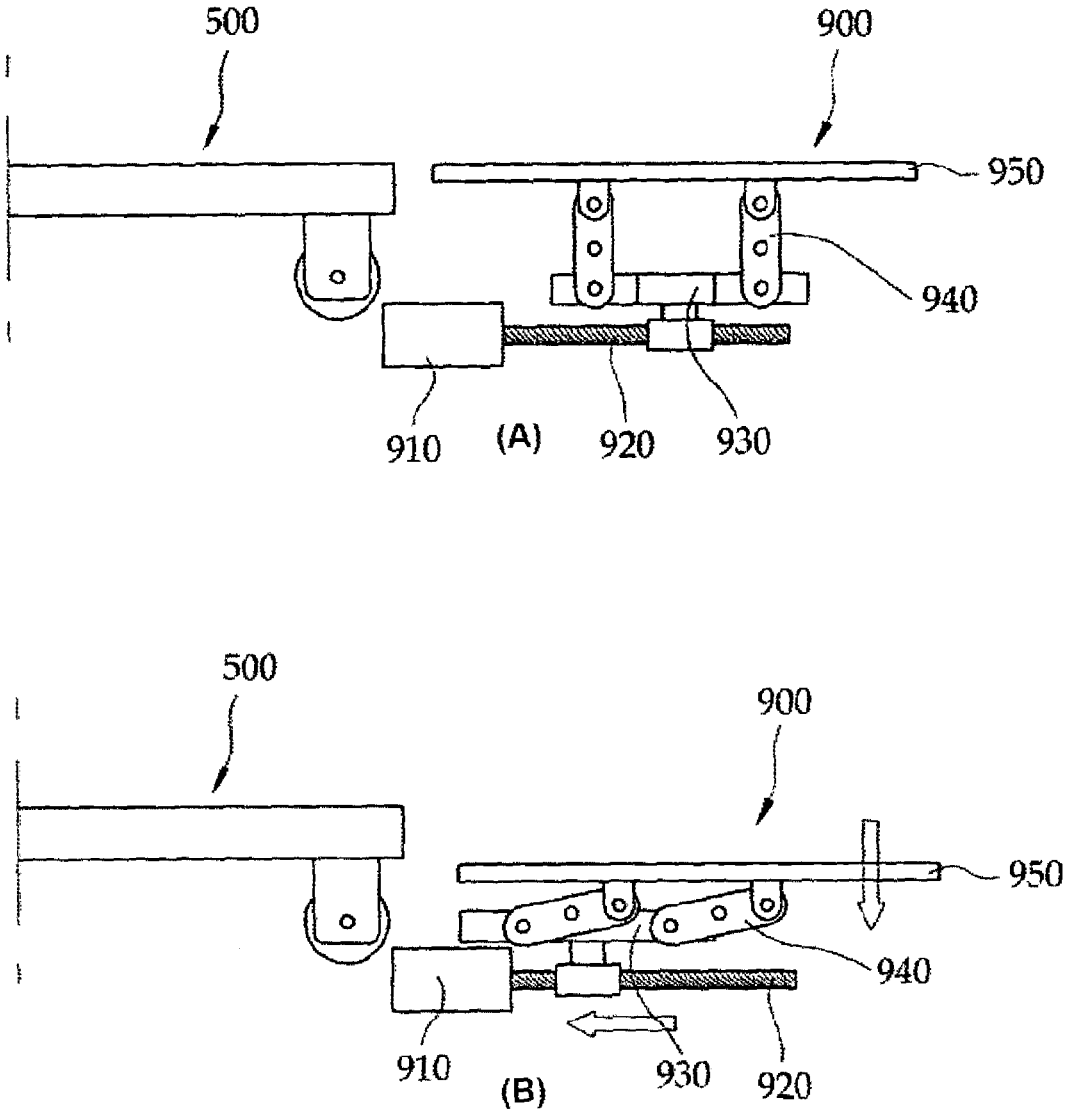
FIGS. 10A and 10B are views showing an operation relation of the auxiliary support frame according to the embodiment of the present invention.

In order to prevent this, in the embodiment, as shown in FIGS. 2, 3 and 10, an auxiliary support flame 900 installed at a rear side of the support deck 500 in an internal space of the running belt 400 is further provided.

As shown in FIG. 10, the auxiliary support frame 900 includes a motor 910 installed at the main frame 100, a ball screw 920 connected to a rotary shaft of the motor 910, a movable bracket 930 movable in a longitudinal direction of the ball screw 920 according to motion of the ball screw 920, a plurality of rotational links 940 installed to be rotatably hinged by interlinking with movement of the movable bracket 930, and a support plate 950 installed on the rotational link 940 and configured to be elevated by rotation of the rotational link 940.

First, the motor 910 is provided separately from the driving motor 210, and fixedly installed at the main frame 100 using a separate bracket, or the like. The movable bracket 930 is installed at the ball screw 920 to be reciprocated in a longitudinal direction of the ball screw 920 according to normal/reverse rotation of the motor 910.

The plurality of rotational links 940 are installed to be rotatably hinged by interlinking with movement of the movable bracket 930. For example, the rotational link 940 may be rotatably installed at the guide rail 140, or may be rotatably installed at a separate support wall (not shown) rather than the guide rail 140.

Reviewing an operational relation of the auxiliary support frame 900, when the exerciser runs, i.e., when the running belt 400 is rotated, the movable bracket 930 is moved to one side along the ball screw 920 by normal rotation of the motor 910, and at this time, the support plate 950 is lowered not o interfere with the forward/rearward movement of the support deck 500.

On the contrary, when the exerciser stops the running, i.e., when rotation of the running belt 400 is stopped, the movable bracket 930 is moved to the other side along the ball screw 920 by reverse rotation of the motor 910, and at this time, the support plate 950 is raised until the upper surface of the support plate 950 is flush with the upper surface of the support deck 500. Accordingly, when an operation of the treadmill is stopped, the entire region of the running belt 400 is substantially supported by the support deck 500) and the support plate 950 to prevent from hanging downward. In particular, when the exerciser steps on the upper rear portion of the running belt 400 to start running, damage to the running belt 400 or a safety accident of the exerciser due to downward depression of the running belt 400 can be prevented.

In the embodiment, when the support plate 950 moves to a peak, the upper surface of the support plate 950 is substantially flush with the upper surface of the support deck, and when the support plate 950 moves downward, the support plate 950 sufficiently moves not to interfere with forward/rearward movement of the support deck. For this reason, a separate limit switch (not shown) configured to restrict a vertical moving distance of the support plate 950 may be further installed at the main frame.

In the embodiment, the motor 910 may be a motor capable of rotating in normal and reverse directions, and may be rotated simultaneously with or after a certain time upon power on/off to the driving motor 210 configured to rotate the front support roller 310.

Hereinafter, an operational relation of the treadmill according to the embodiment will be described.

First, when the exerciser operates a start button of the treadmill, the support plate 950 is lowered and then the driving motor 210 is driven to rotate the running belt 400. Next, the exerciser on the running belt 400) walks or runs to start aerobic exercise. Specifically, when the exerciser applies a force to the running belt to push the running belt 400 rearward with the foot, the running belt 400 is adhered to the support deck 500. While the exerciser applies a force rearward with the foot, adhesion of the running belt 400 and the support deck 500 is maintained, and the support deck 500 is moved rearward in the same direction and speed as the running belt 400. Accordingly, a mutual contact frictional force between the support deck 500 and the running belt 400 can be reduced to minimize damage and breakage of the related parts.

Specifically, a section (a) shown in FIG. 2 is a section in which a propulsive force of the exerciser, i.e., a force in which the exerciser pushes the running belt 400 rearward, is not substantially applied according to a foot position of the exerciser. In the section (a), the running belt 400 is rotated by only the driving force through the driving motor 210.

Next, a section (b) is a section in which the driving force of the driving motor 210 and the propulsive force of exerciser are approximately equally applied.

Next, sections (c) and (d) are sections in which the propulsive force of the exerciser is larger than the driving force of the driving motor 210. In addition, the propulsive force of the exerciser is further increased in the section (d) than the section (c).

Here, the driving force of the driving motor 210 means a force of rotating the running belt 400.

Briefly describing, the section (a) may be applied as a motor-operated running section by driving oft the driving motor 210, the sections (c) and (d) may be applied as a manual running section in which the propulsive force of the exerciser equal to or larger than the driving force of the driving motor 210 is generated, and the section (b) may be applied as a force equilibrium section in which the driving force of the driving motor and the propulsive force of the exerciser are equilibrated.

In the embodiment, since the propulsive force of the exerciser equal to or larger than the driving force of the driving motor 210 is used by the power generating means 800 in the sections (c) and (d), the propulsive force of the exerciser exceeding the driving force of the driving motor 210 is converted into electrical energy to be reused without breaking the law of energy conservation.

Meanwhile, when the exerciser pushes a stop button of the treadmill to stop the operation of the treadmill, the driving of the driving motor 210 is stopped to raise the support plate 950.

Embodiments of the invention have been discussed above with reference to the accompanying drawings. However, those skilled in the art will readily appreciate that the detailed description given herein with respect to these figures is for explanatory purposes as the invention extends beyond these limited embodiments. Accordingly, it will be understood by those skilled in the art that various changes in form and details may be made therein without departing from the spirit and scope of the invention as defined by the appended claims.

The invention claimed is:

1. A treadmill comprising:

a main frame;

a running belt installed in the main frame and rotated by interlocking with rotation of a support roller through an operation of a driving unit; and a pair of left and right support decks provided in an inner space of the running belt and configured to support the running belt when a pressure is applied to an upper surface of the running belt from above, wherein the support decks are movably installed along guide rails installed at the main frame by interlocking with rotation of the running belt and running of a user.

2. The treadmill according to claim 1, further comprising a position recovering means configured to recover the support deck to a front position after rearward movement along the guide rail, wherein the position recovering means comprises:

a fixed piece installed at the main frame and provided with a bearing;

a stopper spaced rearward apart from the fixed piece and installed at a bottom surface of the support deck;

a screw shaft having one end connected to the fixed piece;

a mover threadedly engaged with a screw portion of the screw shaft;

a shock absorbing spring supported by an outer circumferential portion of the screw shaft and installed between the fixed piece and the stopper;

a return spring installed between the stopper and the mover; and a motor connected to the other end of the screw shaft to rotate the screw shaft.

3. The treadmill according to claim 1, further comprising:

a generating motor installed at the main frame and at which a chain gear is installed; and a chain having one end connected to the support deck and installed to be meshed with the chain gear, wherein a one-way bearing is installed between a rotary shaft of the generating motor and the chain gear, the generating motor generates electrical energy when the support deck is moved rearward, and a return spring is installed between the other end of the chain and a support piece of the main frame to be resiliently moved forward again when the support deck is moved rearward to a certain extend or more.

4. The treadmill according to claim 1, further comprising:

a coil portion installed at the main frame in a longitudinal direction of the guide rail; and a magnet installed at a lower portion of the support deck at a position corresponding to the coil portion.

5. The treadmill according to claim 1, further comprising an auxiliary support frame installed in an inner space of the running belt at a rear side of the support deck and configured to prevent the running belt from hanging downward when a load is applied from above in an operation stoppage state of the driving unit, wherein the auxiliary support frame comprises:

a motor installed at the main frame;

a ball screw connected to the rotary shaft of the motor;

a movable bracket moved in a longitudinal direction of the ball screw according to motion of the ball screw;

a plurality of rotational links installed to be rotatably hinged by interlocking with movement of the movable bracket; and a support plate installed at an upper portion of the rotational link and configured to elevate by rotation of the rotational link, wherein an upper surface of the support plate is flush with an upper surface of the support deck when the support plate is raised to be disposed at a peak.

* * * * *